US005899359A

United States Patent [19]

Smith et al.

[11] Patent Number: 5,899,359

[45] Date of Patent: May 4, 1999

[54] DISPENSING VALVE FOR A BULK MATERIAL CONTAINER

[75] Inventors: Mark A. Smith, Westerville; M. Stephen Tschanen, Columbus, both of Ohio

[73] Assignee: Liqui-Box Corporation, Worthington, Ohio

[21] Appl. No.: 08/375,368

[22] Filed: Jan. 19, 1995

[51] Int. Cl.[6] ..... B67D 5/00

[52] U.S. Cl. ..... 222/83; 222/549; 222/554

[58] Field of Search ..... 222/83, 105, 549, 222/554, 559, 563, 561; 251/319, 339; 137/68.3

[56] References Cited

U.S. PATENT DOCUMENTS

| | | | |
|---|---|---|---|
| 754,032 | 3/1904 | Wright | 251/319 X |
| 4,732,298 | 3/1988 | Dinslage | 222/83 |
| 4,739,901 | 4/1988 | Dorfman et al. | 222/83 X |

*Primary Examiner*—Gregory L. Huson
*Attorney, Agent, or Firm*—Vorys Sater Seymour & Pease

[57] ABSTRACT

An improved bulk valve for tapping bulk material such as chemicals or foodstuffs is provided. The bulk valve operates with a piston-like action, in which an inner valve cylinder assembly is drawn open to open a path to a discharge port, or driven shut with a locking plunger to create a firm seal. Serrated puncturing teeth are provided to pierce the membrane seal of the bulk container, and light weight and low cost are achieved.

17 Claims, 7 Drawing Sheets

DISPENSING VALVE FOR A BULK MATERIAL CONTAINER

FIELD OF THE INVENTION

The invention relates to a bulk valve used in the delivery of large quantities of pulp, food, particulate and other material.

BACKGROUND OF THE INVENTION

Bulk materials, particularly but not exclusively food products of different types, are often transported and stored in large plastic or other containers. The containers, sometimes referred to as intermediate bulk containers (IBCs), typically have a capacity of 55 gallons to 330 gallons, the chosen size depending on content, transportation, storage site and other factors. Materials shipped in such bulk containers typically include specialty chemicals including adhesives or solvents, and food products such as juice concentrates or tomato pastes.

After initial manufacture of the material and deposit into the container, the containers are sealed to prevent leakage and contamination by chemicals, bacteria or other influences. The container usually includes an integral spout of some type, to which a dispensing valve may be attached to deliver the bulk material into smaller containers, into lead-off hoses, or otherwise.

Once the material is manufactured and sealed and the container is delivered to a site, the bulk container must be readied to deliver the contents. This usually involves attaching a valve to the spout, by snap-on, screw or other means. Since most containers attempt to preserve the sanitary state of the spout and contents by means of a breakable or frangible membrane across the spout, it is necessary to puncture the membrane to allow removal of the bulk material.

Known valve systems do not generally puncture the spout seal in a thorough, consistent and clean manner. It is known, for example, to attach a protruding nail or spear to an end of the valve which tears through the sealing membrane. This type of structure may be seen, for example, in the Drum Master product of Waddington & Duval, or in the 2" PVC valve product of Magic Plastics. However, those types of puncture devices pierce the membrane imperfectly, leaving large sections or flaps of the membrane which can interfere with the flow of the bulk material out of the container, or possibly break off and contaminate the material. Other sharp, protruding members generally suffer the same disadvantages.

Besides engagement with the spout, many known valve devices for bulk applications include a valve diameter of only a relatively narrow size, sometimes 2" or less, and usually narrower than the diameter of the spout itself. The total volume that the valve can conduct is therefore reduced. The valve action itself may involve a ball (or gate) valve, butterfly valves, or valving of other types, such as that reflected in Valteer products by Waddington-Duval, or an in-line, butterfly valve such as that in the 2" PVC valve by Lasco. Again, however, known designs make somewhat inefficient use of the possible volumetric capacity of the valve.

This means among other things that some bulk materials, particularly granular or particulate bulk materials, can not be made to flow, or flow very readily, from the large container out through the spout and into a smaller container.

Furthermore, may valve devices intended for bulk applications do not attempt to provide a good seal against oxygen, bacterial, chemical or other contamination. Valves, for example, reflected in the PVC I model by Spears or the Multi-Meter model by Rieke (Auburn, Ind.) do not include any sealing rings. O-rings or other sealing devices when provided on known devices may not fit precisely enough to assure a true bacteriological seal, which can compromise the entire contents of the bulk container once tapped.

It also the case that known valve devices are relatively large, heavy, and expensive. A typical valve design suitable for general purpose bulk use may typically cost between $10 and $40, which in bulk applications involving mass production and shipping may not be economical. A typical valve design also may weigh up to three pounds, or more, making attachment and handling more difficult.

SUMMARY OF THE INVENTION

It is accordingly an object of the invention to provide an improved bulk valve which ensures a consistent, clean puncture of container sealing membranes.

It is another object of the invention to provide an improved bulk valve having a high flow capacity.

It is another object of the invention to provide an improved bulk valve which ensures a good seal against, oxygen, bacterial, chemical or other contamination.

It is another object of the invention to provide an improved bulk valve which is relatively easy to manufacture, lightweight, and low in cost.

The invention achieving these and other objects is an improved bulk valve having among its features a combination of a serrated puncturing member, relatively wide throat, light weight, good manufacturability and low cost. The bulk valve of the invention may be provided with a secure sealing system using a compressible sealing ring which prevents bacteriological or other contamination.

The improved bulk valve of the invention may be configured in a T-shaped form for tapping bulk material in a ready, convenient manner.

BRIEF DESCRIPTION OF THE DRAWINGS

The invention will be described with reference to the drawings, in which like parts are labelled with like numbers. The drawings are briefly described below.

DETAILED DESCRIPTION OF THE DRAWINGS

Figure 1:
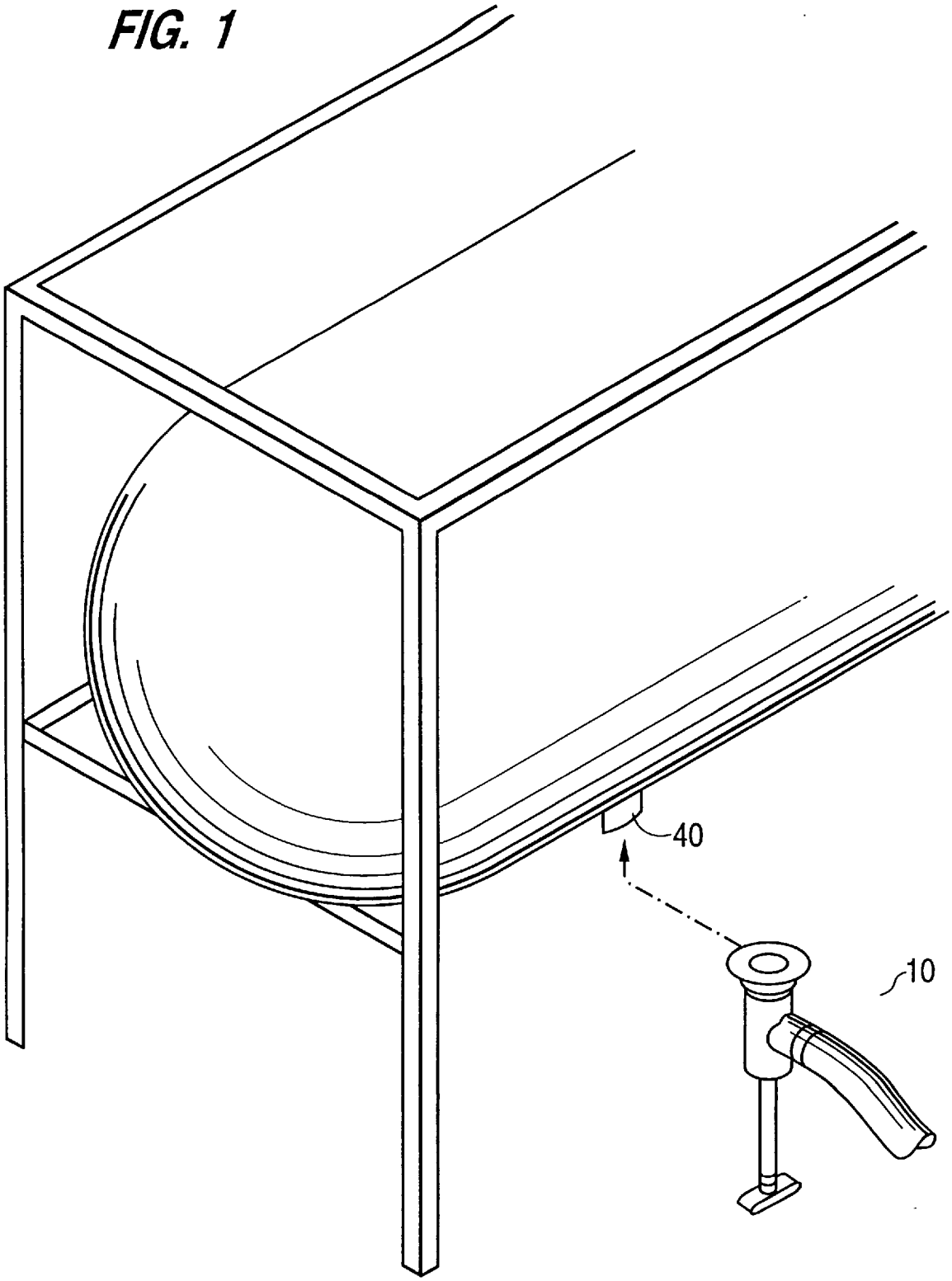
FIG. 1 schematically illustrates the attachment of the improved bulk valve of the invention to a large container.

A first preferred embodiment of the improved bulk valve of the invention is illustrated in FIGS. 1–8. This embodiment generally provides a bulk valve 10 having a tubular valve body 20. A spout end 50 of the bulk valve 10 has threads 30 for screwing engagement of the bulk valve 10 to a spout 40 of a bulk container to be tapped.

Figure 2:
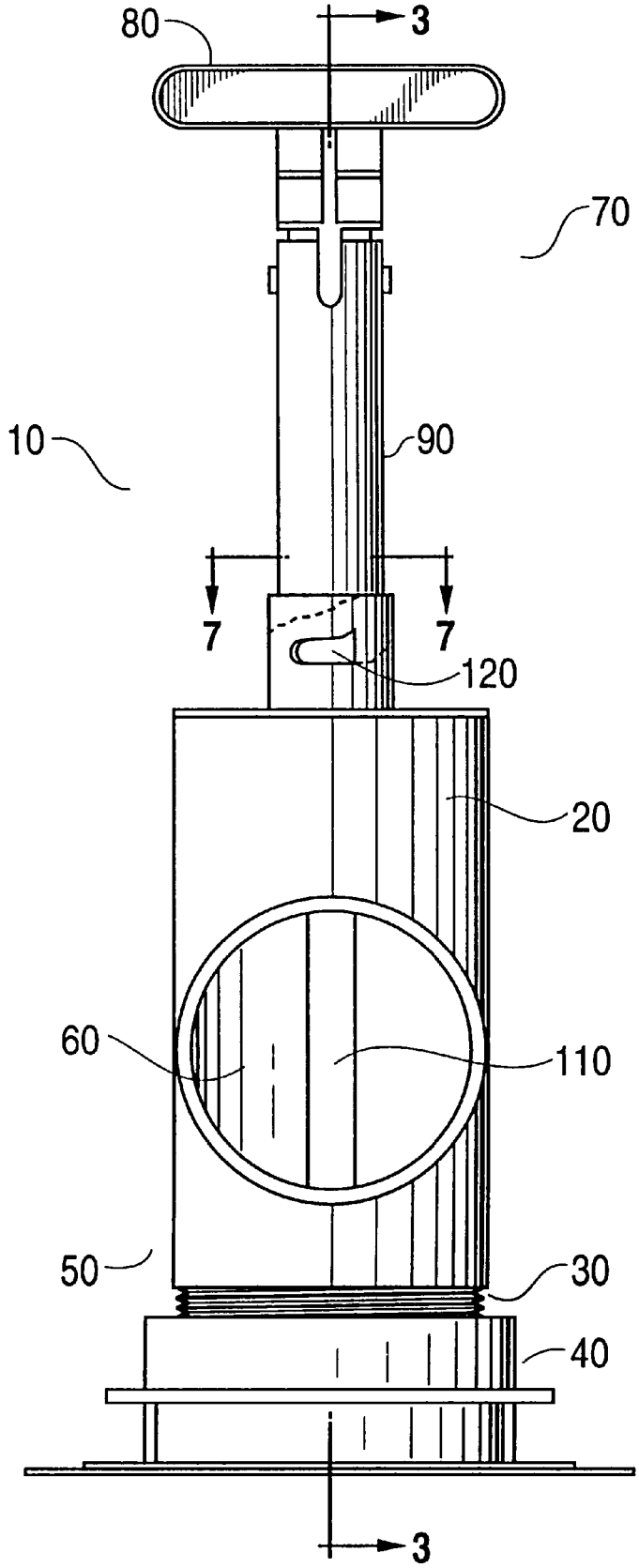
FIG. 2 illustrates a bottom view of a first embodiment of an improved bulk valve according to the invention.

The bulk valve 10 has a valve discharge port 60 for delivering the tapped bulk material into a smaller container, a lead-off hose or otherwise, as illustrated in FIG. 2. Bulk valve 10 includes, at a distal end, a plunger assembly 70 having a handle 80 and a plunger shaft 90 for manually opening and closing the bulk valve 10.

Figure 4:
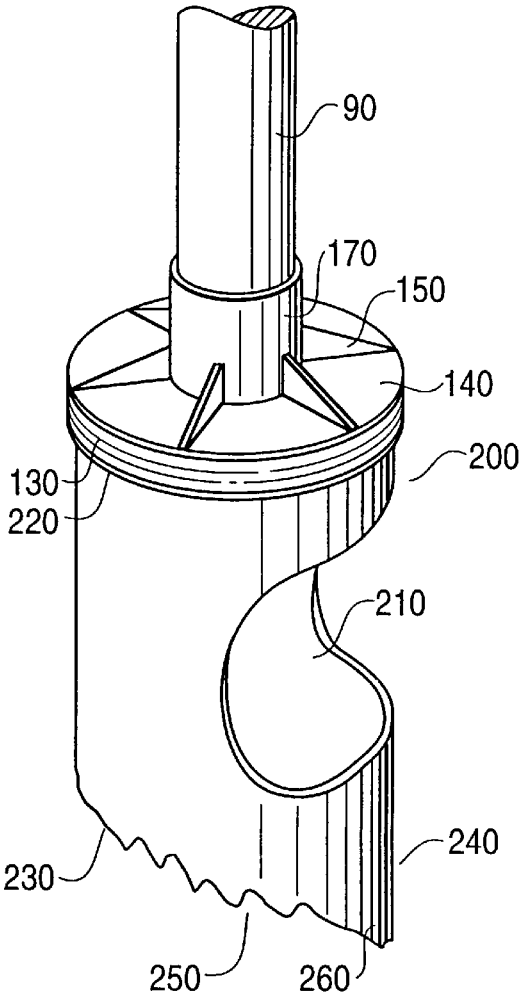
FIG. 4 illustrates an angled side view of the inner valve cylinder of the first embodiment of the improved bulk valve of the invention.
Figure 5:
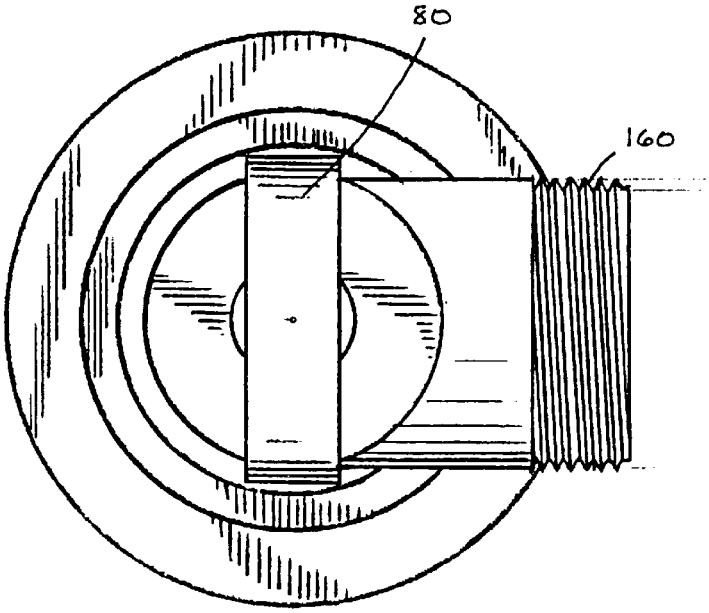
FIG. 5 illustrates an end view of the first embodiment of the improved bulk valve according to the invention from the plunger rod end.
Figure 6:
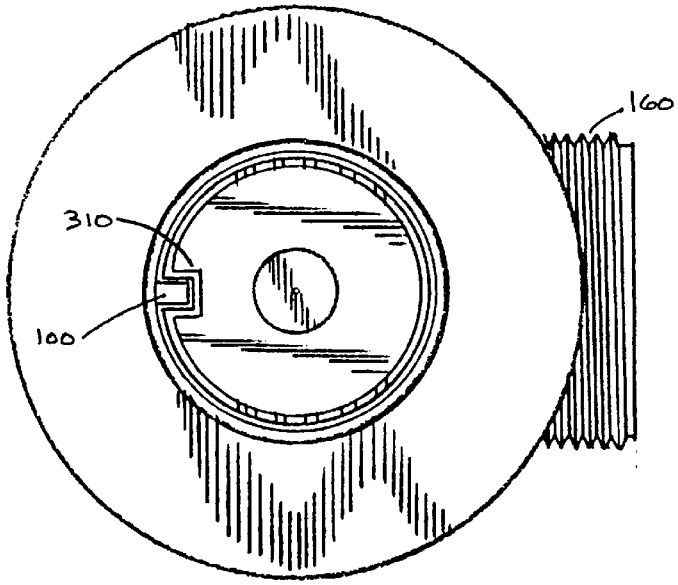
FIG. 6 illustrates an end view of the first embodiment of the improved bulk valve according to the invention from the spout end.
Figure 7:
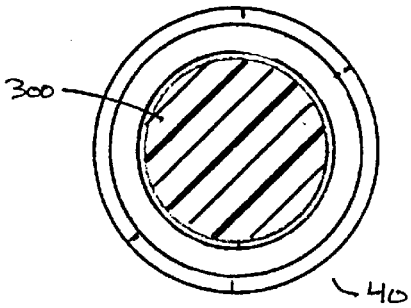
FIG. 7 illustrates a spout to which the bulk valve of the invention may be attached.

The tubular valve body 20 of the bulk valve 10 encloses an internal valve cylinder assembly 200, illustrated in FIG. 4. Inner valve cylinder assembly 200 fits concentrically inside of tubular valve body 20, and slides laterally within the valve body 20 to open and close the valve. Inner valve cylinder assembly 200 is closed at one end most distant from the spout 40 by a valve cylinder top 220, and is open at a valve intake end 230 nearest spout 40 in order to conduct the bulk material out of the bulk container.

Inner valve cylinder assembly 200 may be kept in fixed radial orientation within tubular valve body 20 during opening and closing travel by means of an elevated guiding rib 100 formed in tubular valve body 20, which slideably engages a corresponding guiding track 310 in valve cylinder assembly 200.

Inner valve cylinder assembly 200 likewise includes valve cylinder opening 210 which coincides or overlaps with discharge port 60 to form an aperture to conduct the bulk material through bulk valve 10 to its intended destination.

The lateral movement of valve cylinder assembly 200 by manual stroking of plunger assembly 70 effects opening and closing of discharge port 60 and hence bulk valve 10, in a piston-like fashion more fully described below. Generally, valve cylinder assembly 200 is drawn open to open a path to discharge port 60, or driven shut with a locking plunger to create a firm seal.

Figure 8:
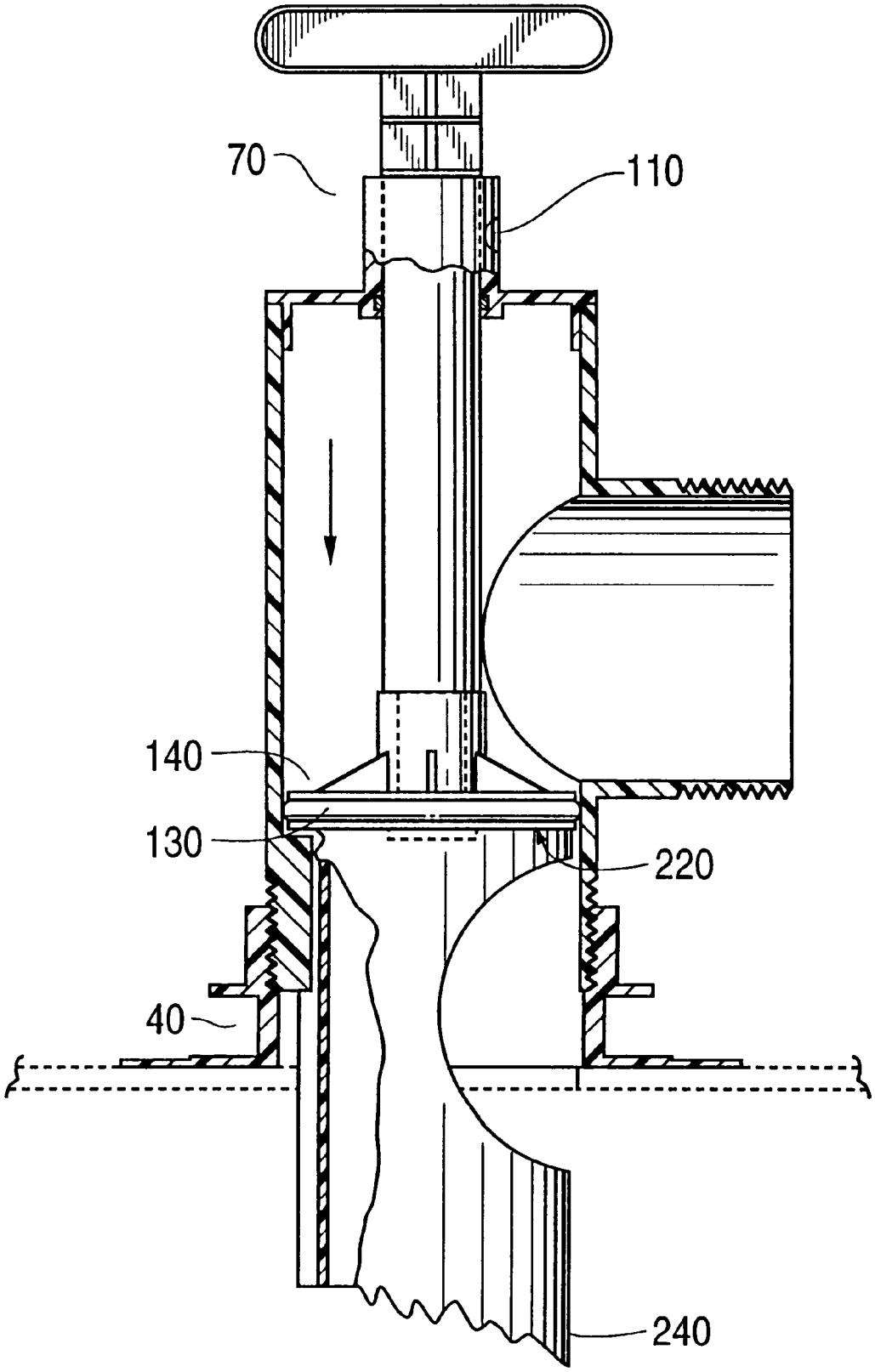
FIG. 8 illustrates a cut-away side view of the first embodiment of the improved bulk valve of the invention, in which the valve is in a closed position.

The bulk valve 10 of the first embodiment is in a closed state, as illustrated in FIG. 8, when the plunger assembly 70 in a depressed position and the inner valve cylinder assembly 200 is generally positioned past discharge port 60, toward the spout end 50 of bulk valve 10. In this position, the inner valve cylinder assembly 200 does not permit the flow of bulk material because valve cylinder top 220 blocks the bulk material from reaching discharge port 60, and no material escapes.

To fully achieve the closed position including the creation of a solid seal, a locking action of plunger assembly 70 takes place. Plunger assembly 70 connects by way of plunger shaft 90 to plunger plate 140. Oriented toward plunger plate 140, in a facing manner, is the valve cylinder top 220. Valve cylinder top 220 is connected to plunger plate 140 by a connecting pin 320 (FIG. 8). That is, the plunger plate 140 and valve cylinder top 190 are separated by a small clearance, but move together when the plunger assembly 70 is stroked because they are connected by connector pin 320. Connector pin 320 may have a small amount of articulation in its joint with both plunger plate 140 and valve cylinder top 220.

Plunger plate 140, which receives the force transmitted by plunger assembly 70, may be reinforced in its connection to plunger shaft 90 by radial support fins 150 attached to shaft support collar 170, in turn attached to shaft 90.

Continuing to describe the bulk valve 10 in a closed position, when the plunger assembly 70 is in a depressed position, plunger plate 140 presses down against compressible ring 130. Plunger assembly 70 extends to an almost-closed position by driving cylinder top 220 and compressible ring 130 to a position just inside of the lip of discharge port 60, as illustrated in FIG. 8. The plunger assembly 70 is then driven home by the rotating closure of a bayonette lock 100. That is, the handle 80 of plunger assembly 70 is rotated (in the illustration, clockwise) which causes a locking pin 110 to rotate into bayonette slot 120.

This rotating motion of plunger assembly 70 translates to a small, incremental lateral movement of plunger shaft 90. This movement of plunger shaft 90 causes plunger plate 140 to press against compressible ring 130 in one final increment. This final increment is sufficient to force radial deformation of the compressible ring 130 against the inner walls of tubular valve body 20. This creates a solid, effective seal between the tubular valve body 20 and inner valve cylinder assembly 200. Compressible seals of this general type may be seen, for instance, in U.S. Pat. Nos. 5,031,676, 4,991,635, or 4,874,023, which patents are incorporated here by reference. Different types and widths of O-ring or D-ring seals for use in compressible ring 130 will be familiar to persons skilled in the art.

The result of the locking closure of compressible ring 130 is a true seal in the bulk valve 10 in its closed position. The possibility of contamination of the bulk contents by bacteria, chemicals, oxygen or other foreign matter is greatly reduced, an advantage that known designs do not offer.

To open the bulk valve 10 of the first embodiment, the plunger handle 80 is twisted in an opposite direction to the locking direction, to release the bayonette lock 100 by sliding locking pin 110 out of slot 120. This results in a corresponding, small retrograde motion of the plunger assembly 70, releasing compressible ring 130 from compressive contact with the inner wall of tubular valve body 20. Inner valve assembly 200 is thus freed for traverse into an open position, generally illustrated in FIG. 3. That releasing travel is accomplished by pulling back on plunger handle 80 in a direction away from spout 40, causing valve cylinder assembly 200 to travel away from spout 40.

Figure 3:
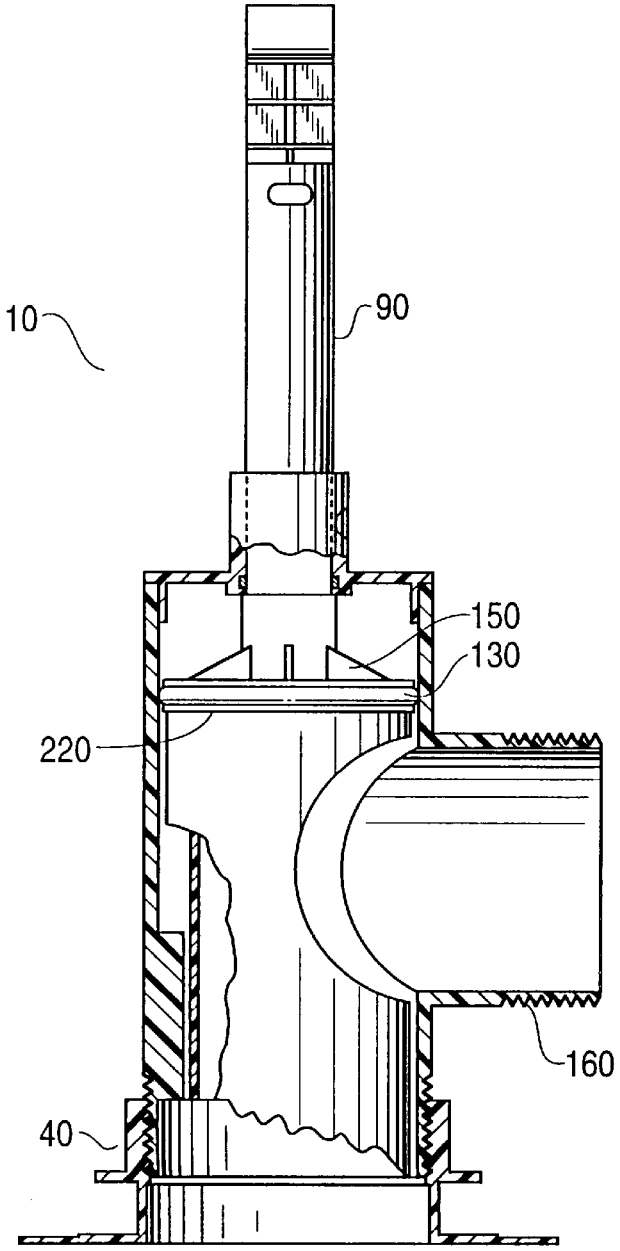
FIG. 3 illustrates a cut-away side view of the first embodiment of the improved bulk valve according to the invention, in which the valve is in an open position.

As valve cylinder assembly 200 travels inside of tubular valve body 20 away from spout 40, valve cylinder opening 210 begins to coincide or overlap with discharge port 60, creating an open aperture for discharge of the bulk material. Discharge port 60 may be provided with discharge connector threads 160, as illustrated in FIG. 3, for connection to lead-off hoses or other discharge apparatus. Discharge may be by gravity, pump or other means.

The degree of overlap of valve cylinder opening 210 with discharge port 60 may be controlled by drawing plunger handle 80 back to a desired position. Or bulk valve 10 may be completely opened by pulling plunger handle 80 back to its limit, at which position discharge port 60 and valve cylinder opening 210 overlap completely.

Because discharge port 60 may be made to have a relatively broad diameter, at least as large as tubular valve body 20, and with valve cylinder opening 210 being made correspondingly wide, the flow rate of the volumetric path of the bulk valve 10 can be made rather high. That is, inner valve cylinder assembly 200 fits concentrically inside of tubular valve body 20 but takes up only a marginal amount of radial space, corresponding to the wall thickness of the inner valve assembly 200, so almost all of the cross-sectional area of tubular valve body 20 is available to conduct material, leading to high utilization of flow capacity, unlike known designs.

In terms of attaching the bulk valve 10 to spout 40 and the bulk container itself, the bulk vale 10 of the invention includes a puncturing member 240 to break the membrane seal 300 of the bulk container. Puncturing member 240 as illustrated consists of staggered, serrated teeth 250 formed in the valve intake end 230 of the valve cylinder assembly 200.

When plunger assembly 70 is driven into a closed position upon attachment to a bulk container, puncturing member 240 is driven into the spout 40 and pierces membrane 300 of the bulk container. The membrane punctured by the puncturing member 240 with its serrated teeth 250 tends to lack shreds or stringers which may contaminate the bulk material. Puncturing member 240 also ensures that the membrane is broken in a consistent manner with repeated use. The bulk material can then be dispensed out of the spout 40 through the punctured membrane seal 300, at the bottom of the bulk container.

The teeth 250 may be staggered so that the membrane seal of the bulk container is pierced to allow a desired portion, for instance preferably 20%, of the sealing membrane to stay in place in a top portion of the membrane seal 300. The portion of the membrane that is preserved can be altered to effect different flow characteristics as the bulk material is discharged through the spout.

In the illustrated embodiment, teeth 250 are arranged as a plurality of matching pairs of increasing size on either side of the circumference of inner valve cylinder assembly 200 at the valve intake end 230, culminating in one large, arrowhead shaped leading tooth 260. Other serrated arrangements are possible.

The improved bulk valve 10 of the invention may be used in a disposable fashion, being discarded after each container is fully tapped. Bulk valve 10 may be made of any suitable material, for example but not limited to, ABS, nylon, or polystyrene. Because of its economical, logical construction, the bulk valve of the invention can be manufactured at a competitive cost, with a relatively low weight and greater ease of use, than known valve designs for bulk applications.

Figure 9:
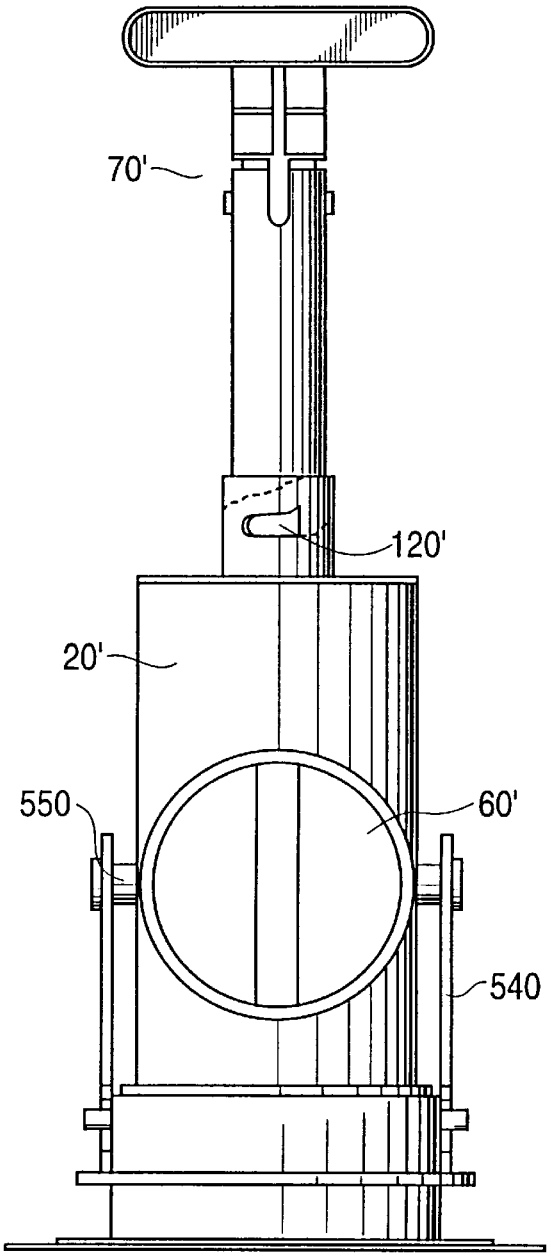
FIG. 9 illustrates a bottom view of a second embodiment of an improved bulk valve according to the invention.
Figure 10:
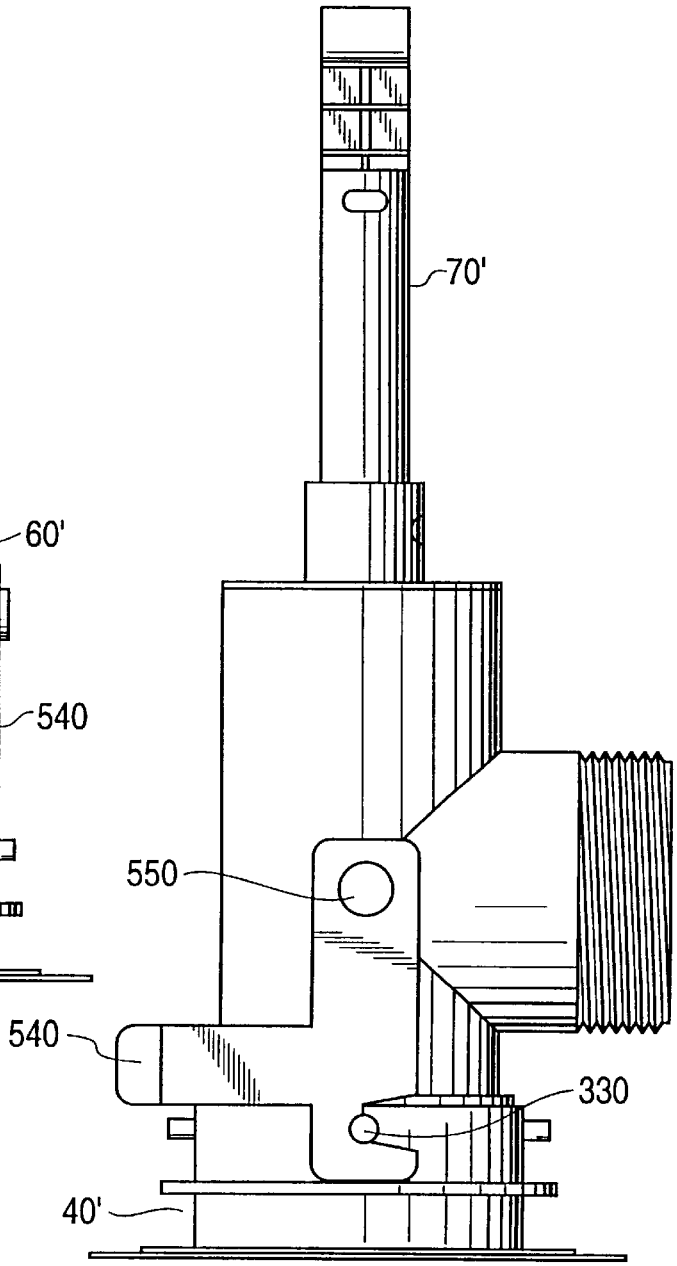
FIG. 10 illustrates a side view of the second embodiment of an improved bulk valve according to the invention.
Figure 11:
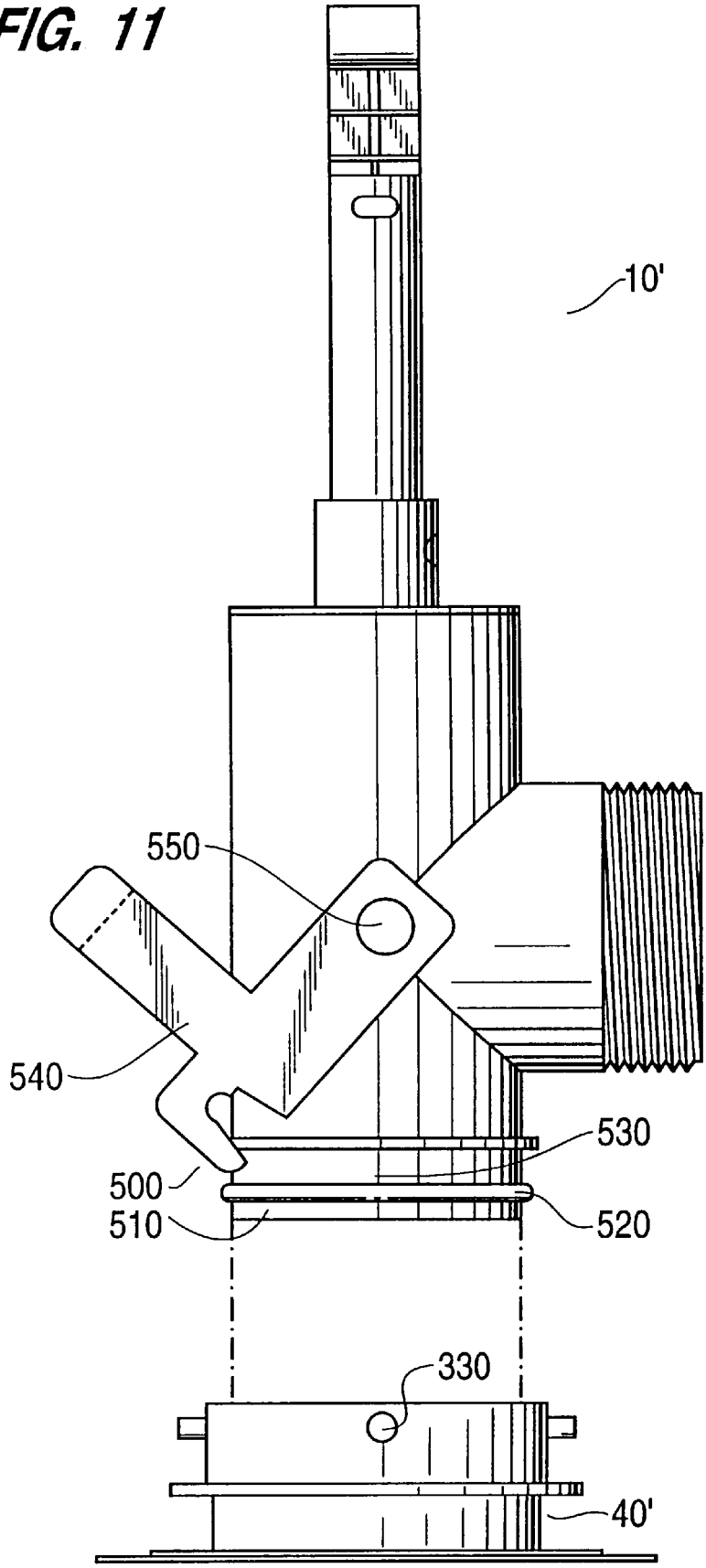
FIG. 11 illustrates the attachment of the improved bulk valve of the second embodiment to a spout.

A second embodiment of the improved bulk valve of the invention is illustrated generally in FIGS. 9–11, in which like parts are designated with like numbers, but with a prime marking. The second bulk valve embodiment is generally similar to the first, but includes structure for enhancing the sanitary condition of the bulk valve, particularly in its connection to spout 40. Bulk valve 10' of the second embodiment includes at the spout end 50' a spout sealing portion 500. Spout sealing portion 500 comprises a spout ring skirt 510, in which is inserted a spout sealing ring 520. Spout sealing ring 520 may be of any suitable known type. Spout sealing portion 500 likewise includes a spout engagement collar 530, positioned a short distance from spout ring skirt 510 toward the distal end of bulk valve 10'.

Bulk valve 10' also includes a spout closing harness 540 which is rotatably attached to bulk valve 10' by means of harness pins 550. Spout closing harness has a pair of spout engagement sockets 560. To secure bulk valve 10' of the second embodiment to a spout, spout sealing portion 500 is slideably inserted into a corresponding spout on the bulk container. The spout on the bulk container will include a pair of engagement pins 330 located on the circumference of the spout at a position corresponding to spout engagement sockets 560.

To fasten bulk valve 10' to the spout, spout closing harness 540 is swung down so that spout engagement sockets 560 come into contact with, and snap onto, the engagement pins 330 on the spout, in snap-down fashion. This secures bulk valve 10' to the spout, with spout sealing ring 520 providing a solid seal against the inner wall of the spout, preventing bacterial, chemical, oxygen or other contamination at the spout connection itself. This type of sanitary sealing, which is in addition to the sealing effected by compressible ring 130' within the tubular valve body 20', is particularly useful for delivery of food products, such as milk.

In the bulk valve 10' of the second embodiment, the plunger assembly 70', puncturing member 240' and other structure work in a similar fashion to that described before, resulting in good seal-puncturing performance, good flow rates, relatively low cost and easy, economical operation.

The foregoing description of the improved bulk valve of the invention is illustrative, and variations on certain aspects of the inventive system will occur to persons skilled in the art. The scope of the invention is accordingly intended to be limited only by the following claims.

We claim:

1. A dispensing valve for attachment to a container for fluent bulk material, comprising:

a hollow cylindrical valve body, having an open intake end, a valve body wall, and a discharge port in said valve body wall;

attachment means for attaching said intake end of said valve body to a dispensing spout on a container for bulk fluent material;

an inner hollow valve cylinder located within said hollow valve body, said inner valve cylinder comprising:

an open end, a closed end, and a cylinder wall having an opening therein, said inner valve cylinder being slidable within said hollow valve body between an open position in which said opening in said cylinder wall is at least partially in register with said discharge port, and a closed position in which said closed end of said valve cylinder is positioned between said intake end of said valve body and said discharge port and, sealing means at said closed end of said valve cylinder, for providing a seal between said inner valve cylinder and said valve body wall; and actuating means, for sliding said valve cylinder between said open position and said closed position and for actuating.

2. A dispensing valve according to claim 1, wherein said sealing means further comprises:

a sealing ring attached to said closed end of said inner valve cylinder; and a seal compression member, attached to said closed end of said inner valve cylinder, said seal compression member compressing said sealing ring when actuated by said actuating member, whereby said sealing ring is deformed and sealingly engages said valve body wall.

3. A dispensing valve according to claim 2 wherein said actuating means comprises a valve plunger.

4. A dispensing valve according to claim 1, for use with a container having a sealing membrane, wherein said dispensing valve further comprises a puncturing member, attached to said open end of said inner valve cylinder, for puncturing the sealing membrane of the container.

5. A dispensing valve according to claim 4, wherein said puncturing member comprises a serrated edge member.

6. A dispensing valve according to claim 5, wherein said serrated edge member comprises a plurality of serrated edges.

7. A dispensing valve according to claim 6, wherein said serrated edges are generally staggered.

8. A dispensing valve according to claim 7, wherein said serrated edges leave about 20% of the sealing membrane intact.

9. A dispensing valve according to claim 1, wherein said attachment means comprises a thread on said intake end for engaging said dispensing spout on the container.

10. A dispensing valve for attachment to a container for fluent bulk material, comprising:

a hollow cylindrical valve body, having an open intake end, a cylindrical valve body wall, and a discharge port in said valve body wall;

attachment means for attaching said intake end of said valve body to a dispensing spout on a container for bulk fluent material, said attachment means comprising:

an engagement member for releasably attaching said intake end of said valve body to said dispensing spout of the container, and a sanitary seal, attached to said intake end of said hollow valve body, which sanitarily seals the valve to the spout when said engagement member is attached to the spout;

an inner hollow valve cylinder located within said hollow valve body, said valve cylinder comprising:

an open end, a closed end, and a cylinder wall having an opening therein, and inner valve cylinder being slidable within said hollow valve body between an open position in which said opening in said cylinder wall is at least partially in register coincides with said discharge port, and a closed position in which said closed end of said valve cylinder is positioned between said intake end of said valve body and said discharge port, and sealing means at said closed end of said valve cylinder, for providing a seal between said valve cylinder and said valve body wall; and actuating means, for sliding said valve cylinder between said open position and said closed position and for actuating said sealing means.

11. A dispensing valve according to claim 1, wherein said sealing means further comprises:

sealing ring attached to said closed end of said inner valve cylinder; and a seal compression member, attached to said closed end of said inner valve cylinder, said seal compression member compressing said sealing ring when actuated by said actuating member, whereby said sealing ring is deformed and sealingly engages said valve body wall.

12. A dispensing valve according to claim 11 wherein said actuating means comprises a valve plunger.

13. A dispensing valve according to claim 10, for use with a container having a sealing membrane, wherein said dispensing valve further comprises a puncturing member, attached to said open end of said inner valve cylinder, for puncturing the sealing membrane of the container.

14. A dispensing valve according to claim 13, wherein said puncturing member comprises a serrated edge member.

15. A dispensing valve according to claim 14, wherein said serrated edge member comprises a plurality of serrated edges.

16. A dispensing valve according to claim 15, wherein said serrated edges are generally staggered.

17. A dispensing valve according to claim 16, wherein said serrated edges leave about 20% of the sealing membrane intact.

* * * * *